US007416381B2

(12) United States Patent
Baek et al.

(10) Patent No.: US 7,416,381 B2
(45) Date of Patent: Aug. 26, 2008

(54) IMPELLER FOR FUEL PUMPS

(75) Inventors: Se-Dong Baek, Chungcheongnam-Do (KR); Jae-Seung Park, Daejeon-si (KR); Young-Hoon Kim, Daegu-si (KR); Sung-Uk Chang, Daejeon-si (KR)

(73) Assignee: Korea Automotive Fuel Systems Ltd. (KR)

( * ) Notice: Subject to any disclaimer, the term of this patent is extended or adjusted under 35 U.S.C. 154(b) by 286 days.

(21) Appl. No.: 11/450,825

(22) Filed: Jun. 9, 2006

(65) Prior Publication Data

US 2006/0228207 A1 Oct. 12, 2006

Related U.S. Application Data

(63) Continuation-in-part of application No. 10/900,633, filed on Jul. 28, 2004, now abandoned.

(30) Foreign Application Priority Data

Apr. 13, 2004 (KR) ..... 2004-0025432

(51) Int. Cl.
*F04D 5/00* (2006.01)

(52) U.S. Cl. ..... 415/52.1; 415/53.1; 416/237; 416/DIG. 2

(58) Field of Classification Search ..... 415/52.1, 415/53.1, 54.1–7; 416/237, 238, DIG. 2
See application file for complete search history.

(56) References Cited

U.S. PATENT DOCUMENTS

| | | | | |
|---|---|---|---|---|
| 2,042,499 | A | 6/1936 | Brady | 415/55.4 |
| 5,762,469 | A | 6/1998 | Yu | 415/55.1 |
| 6,113,363 | A | 9/2000 | Talaski | 417/423.3 |
| 6,152,687 | A | 11/2000 | Wilhelm et al. | 415/55.1 |
| 6,497,552 | B2 | 12/2002 | Kobayashi et al. | 415/55.1 |
| 6,533,538 | B2 | 3/2003 | Aslam et al. | 415/55.1 |
| 6,767,179 | B2 * | 7/2004 | Kusagaya et al. | 415/55.1 |
| 6,932,562 | B2 | 8/2005 | Ross | 415/55.1 |
| 2003/0026686 | A1 | 2/2003 | Kusagaya et al. | 415/55.1 |

* cited by examiner

*Primary Examiner*—Igor Kershteyn
(74) *Attorney, Agent, or Firm*—Tuchman & Park LLC

(57) ABSTRACT

A fuel pump for a vehicle comprises: a driving motor; an impeller having a substantially circular shape, the impeller being rotatable by operation of the driving motor; and a pump casing covered with a casing cover, the pump casing and casing cover together defining a central cavity for receiving the impeller rotatable therein, the pump casing and casing cover including a fuel inlet port and a fuel outlet port, the pump casing and casing cover each further including a circular groove formed along the surface thereof in respective fluid communication with the central cavity of the pump casing and casing cover. The impeller includes a plurality blades of generally V-shape cross-section disposed along an outer surface of the impeller with a plurality of blade grooves defined between the blades, the blade grooves in fluid communication with respective circular groove of the pump casing and casing cover, wherein each of the blades includes a fuel inlet blade portion disposed at an inner area of the blade grooves and a fuel outlet blade portion disposed at an outer area of the blade grooves, with a boundary portion disposed between the fuel inlet blade portion and the fuel outlet blade portion, in which a front surface angle and a rear surface angle of each of the fuel inlet blade portion and the fuel outlet blade portion respectively varies relative to the length of each of the blades.

11 Claims, 11 Drawing Sheets

IMPELLER FOR FUEL PUMPS

CROSS-REFERENCE TO RELATED APPLICATIONS

The present application is a continuation-in-part of U.S. patent application Ser. No. 10/900,633, filed Jul. 28, 2004, now abandoned and entitled "Impeller For Fuel Pumps", which application is currently pending and claimed priority from Korean Patent Application 2004-0025432 filed on Apr. 13, 2004.

FIELD OF THE INVENTION

The present invention relates, in general, to fuel pumps for vehicles and, more particularly, to an impeller for fuel pumps of automobiles which increases the fuel pumping efficiency and the amount of fuel discharge of the fuel pumps by controlling the fuel guide angles of the blades of the impeller, thus providing high operational pressures of the fuel pumps.

BACKGROUND OF THE INVENTION

Fuel pumps are devices that are provided in automobiles to effectively feed fuel from a fuel tank to a fuel injection system of an engine.

Among the fuel pumps, a turbine-type fuel pump is well known in the art. As shown in FIG. 1, a fuel pump for automobiles typically comprises a pump housing 200 which is fabricated with an upper casing 210 and a lower casing 220. An impeller 300 is installed in the pump housing 200 to rotate, while a drive motor 400 is coupled to the impeller 300 via a drive shaft which transmits a rotating force of the motor 400 to the impeller 300 to rotate the impeller 300 within the pump housing 200. The fuel pump further comprises a check valve 500 to controllably discharge the fuel from the fuel pump to an injector of an engine while the fuel is drawn into and discharged from the fuel pump by the centrifugal force of the rotating impeller 300.

The impeller 300 of the conventional fuel pump comprises a disc-shaped body as shown in FIG. 2. A plurality of radial blades 320 are provided around the outer edge of the impeller 300 while being spaced out at regular intervals, with a plurality of fluid communication chambers (hereinafter to be referred as blade grooves) 340 defined between the blades 320 such that each of the blade grooves 340 is vertically formed through the disc-shaped impeller 300.

In FIGS. 1 and 2 of the accompanying drawings, the reference numerals 230 and 240 respectively denote a fuel inlet port and a fuel outlet port of the pump housing 200 to introduce and discharge the fuel into and from the pump housing 200 during a rotation of the impeller 300.

The above-mentioned impeller 300 is operated as follows during an operation of the fuel pump. When the impeller 300 rotates by the rotating force of the drive motor 400, fuel is forcibly discharged outward from the fuel outlet region of each blade groove 340 in a radial direction by the centrifugal force of the rotating impeller 300. The fuel discharged from each blade groove 340 collides with and thus is guided by an inner surface of a fuel path defined between the upper and lower casings 210 and 220 of the pump housing 200, thus being forced to flow into the fuel inlet region of an adjacent blade groove 340, so that the fuel sequentially circulates through the blade grooves 340 and the pressure of the fuel gradually increases. As such, the outside area of the blade grooves becomes a fuel outlet region and the inside area of the blade grooves becomes a fuel inlet region. In a brief description, the kinetic energy of the impeller 300 during a rotation of the impeller 300 is transmitted to the fuel, so that the pressurized fuel is pumped from a fuel tank to an injector of an engine.

In the meantime, the operational pressures of the fuel pumps of automobiles are typically determined according to engine capacities. In recent years, the fuel pumps of automobiles are required to provide high operational pressures. However, in the fuel pumps having the above-mentioned conventional impellers, an increase in the amount of fuel discharge from the fuel pumps during the high-pressure operations of the fuel pumps is limited. Thus, impellers for fuel pumps of automobiles capable of increasing the amount of the fuel discharge during the high-pressure operations of the fuel pumps have been actively studied in recent years.

For example, U.S. Pat. Nos. 6,533,538 and 6,767,179 disclose certain impeller structures contemplated to improve the pump efficiency while reducing disturbance and frictions in the fuel flow in fuel pumps. However, these known impellers do not typically provide an optimized fluid flow about the impeller. More particularly, because these impellers are typically shaped to have either gradually increasing or gradually decreasing surfaces in their front and rear surfaces of the blades, the fuel inlet region and the fuel outlet region are not well divided and thus causes complex fluid flows, such as disturbance in the flow, which in turn leads to deterioration in the fuel pump performance.

SUMMARY OF THE INVENTION

Accordingly, the present invention has been made keeping in mind the above problems occurring in the prior art, and an object of the present invention is to provide an impeller for fuel pumps of automobiles, in which the structure of blades that feed fuel from a fuel tank to an injector of an engine is changed to increase the fuel discharge efficiency of the fuel pump during a high-pressure operation of the fuel pump, thus improving operational performance of the fuel pump.

Another object of the present invention is to provide an impeller for fuel pumps of automobiles, in which the fuel inlet region and the fuel outlet region are distinctively divided for reducing the disturbance or other complex flow problems in the boundary area between the fuel inlet region and the fuel outlet region.

In order to achieve the above and other objects, a fuel pump for a vehicle according to one aspect of the present invention provides: a driving motor; an impeller having a substantially circular shape, the impeller being rotatable by operation of the driving motor; and a pump casing covered with a casing cover, the pump casing and casing cover together defining a central cavity for receiving the impeller rotatable therein, the pump casing and casing cover including a fuel inlet port and a fuel outlet port, the pump casing and casing cover each further including a circular groove formed along the surface thereof in respective fluid communication with the central cavity of the pump casing and casing cover. The impeller includes a plurality blades of generally V-shape cross-section disposed along an outer surface of the impeller with a plurality of blade grooves defined between the blades, the blade grooves in fluid communication with respective circular groove of the pump casing and casing cover, wherein each of the blades includes a fuel inlet blade portion disposed at an inner area of the blade grooves and a fuel outlet blade portion disposed at an outer area of the blade grooves, with a boundary portion disposed between the fuel inlet blade portion and the fuel outlet blade portion, in which a front surface angle and a rear surface angle of each of the fuel inlet blade portion and the fuel outlet blade portion respectively varies relative to the length of each of the blades.

According to another aspect of the present invention, an impeller is provided for a vehicle fuel pump. The fuel pump preferably includes a pump casing and a casing cover coupled with each other face to face and having a central cavity defined therein. The pump casing and casing cover each further preferably includes a circular groove formed along a respective inner surface opposing to each other, with the respective circular groove in fluid communication with the central cavity of the pump casing and casing cover. The impeller of the fuel pump of the invention comprises: an impeller body formed in a substantially circular shape, the impeller body being rotatably disposed in the central cavity of the pump casing and casing cover; a plurality blades of generally V-shape cross-section disposed along an outer surface of the impeller body with a plurality of blade grooves defined between the blades, the blade grooves in fluid communication with the respective circular groove of the pump casing and casing cover; and a ridge projecting horizontally outwards from an outer surface of the impeller body at an inner area of each of the blade grooves; wherein each of the blades includes a fuel inlet blade portion disposed at an inner area of the blade and a fuel outlet blade portion disposed at an outer area of the blade, a boundary portion disposed between the fuel inlet blade portion and the fuel outlet blade portion, a front surface angle and a rear surface angle of each of the fuel inlet blade portion and the fuel outlet blade portion respectively varying relative to the length of each of the blades.

Each of the blades of the impeller is preferably configured to have the front surface angle and rear surface angle of the fuel inlet blade portion and the rear surface angle of the fuel outlet blade portion, respectively, gradually increasing, and the front surface angle of the fuel outlet blade portion first gradually decreasing and then gradually increasing, as they respectively approaches from a root area of the blade towards a tip area of the blade.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
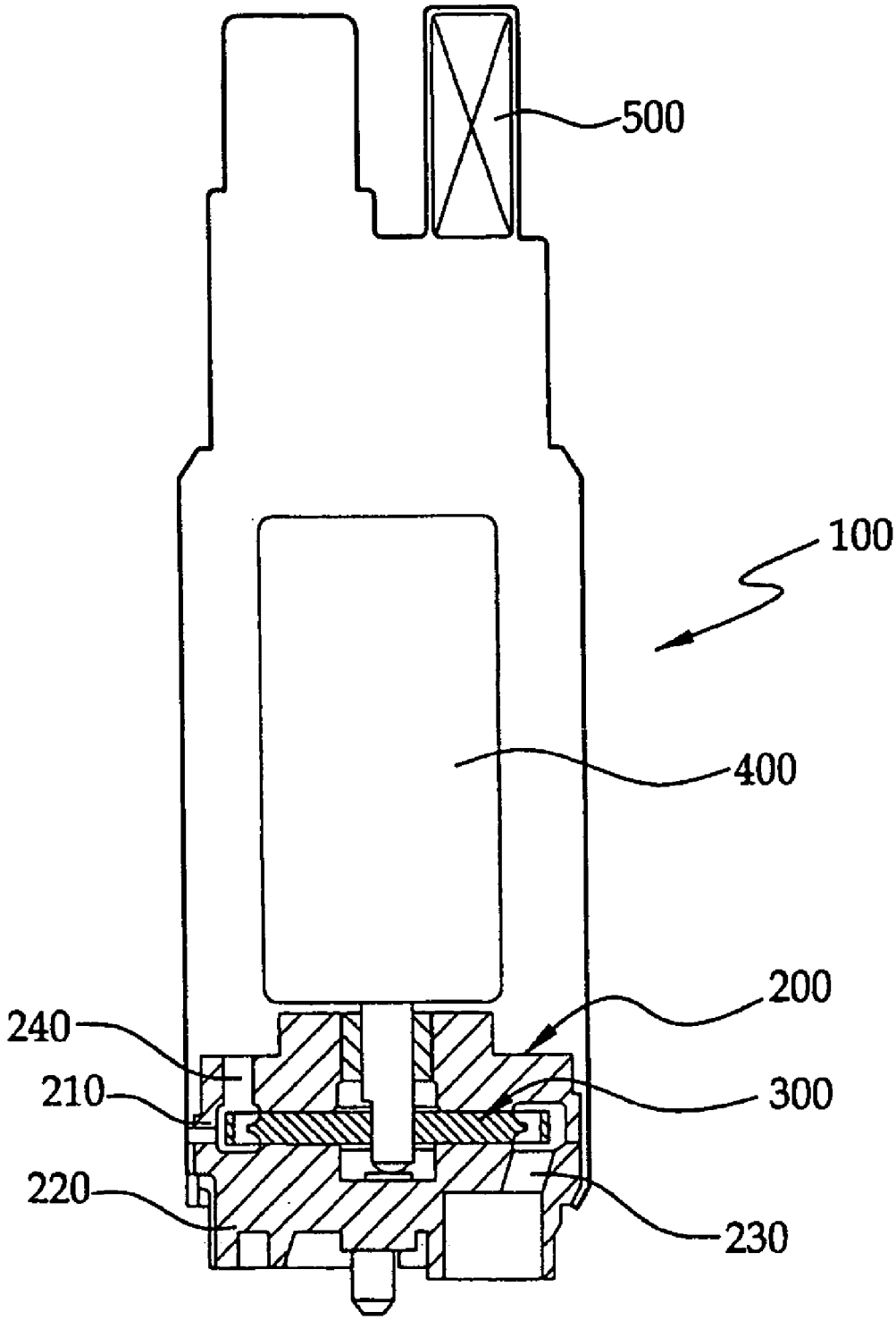
FIG. 1 is a front sectional view illustrating the construction of a typical fuel pump for automobiles, to which the impeller of the present invention may be applied.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 3:
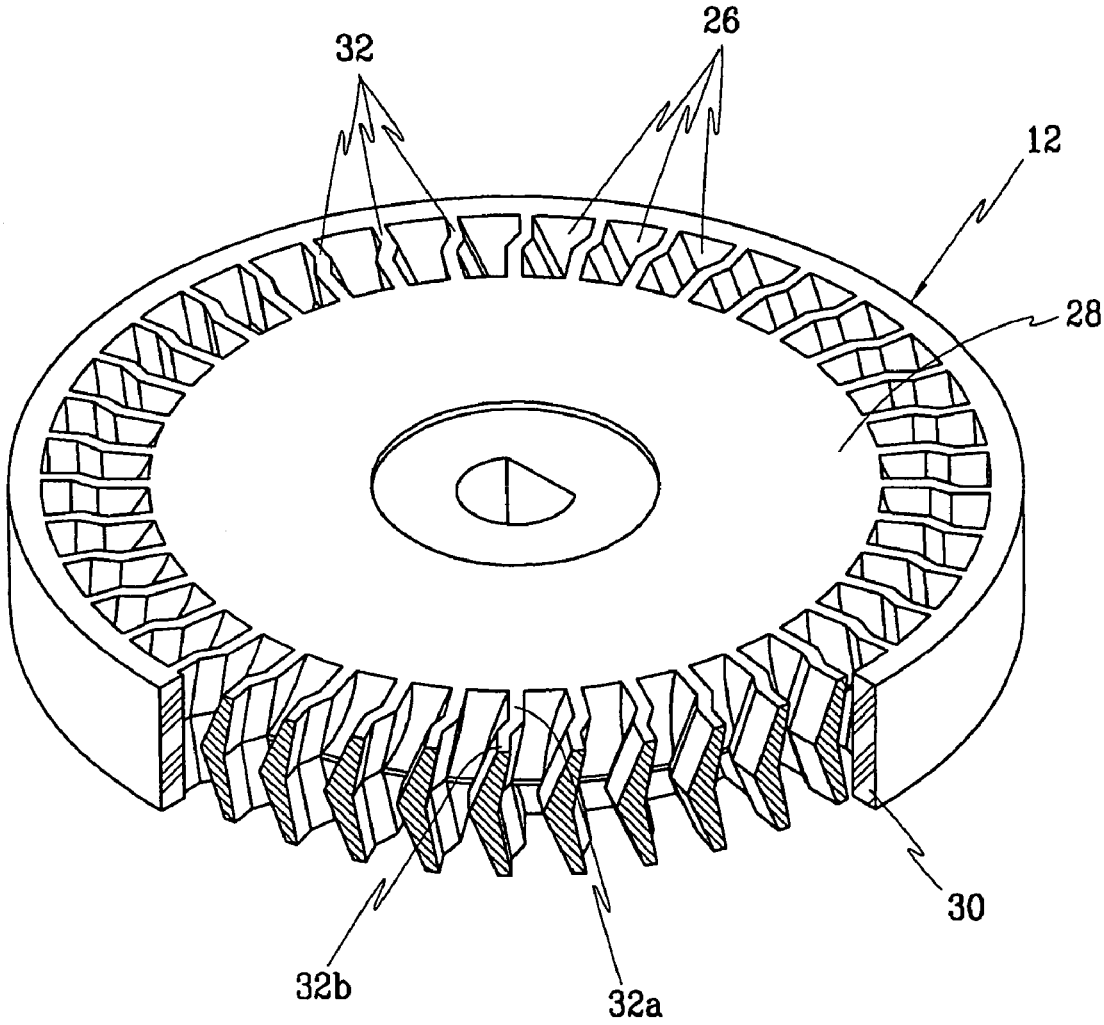
FIG. 3 is a partially broken perspective view of an impeller according to a preferred embodiment of the present invention.
Figure 4:
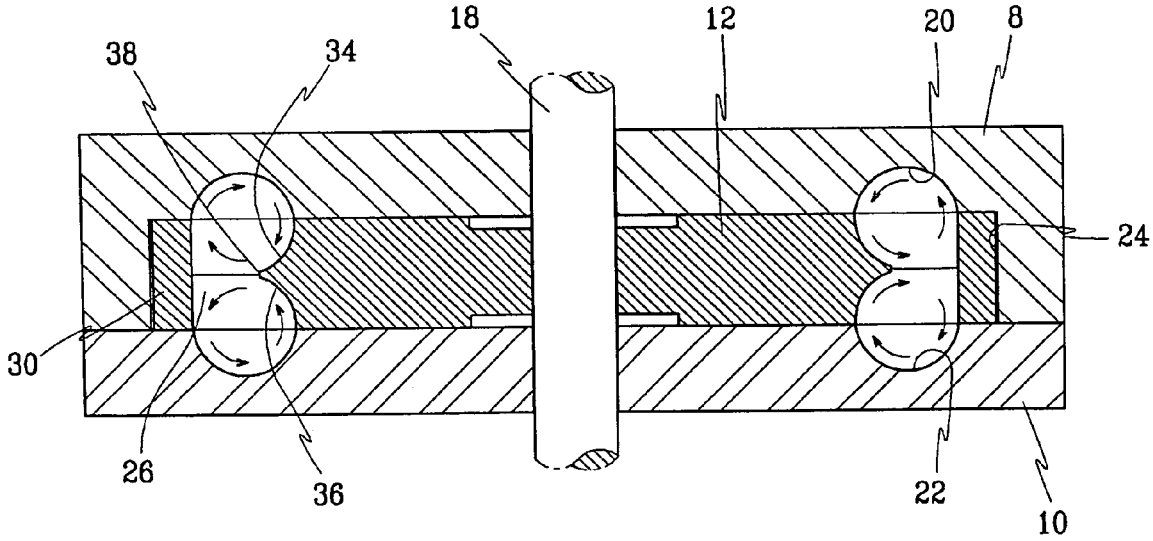
FIG. 4 is a sectional view illustrating the position and operation of the impeller of FIG. 3 when the impeller is installed in a fuel pump.

FIG. 3 is perspective views of an impeller according to the preferred embodiment of the present invention. FIG. 4 is a sectional view illustrating a fuel path in a pump housing when the impeller is installed in the fuel pump. The impeller of the present invention can be installed or assembled into the fuel pump of a vehicle in a manner and construction as illustrated and described above in connection with FIG. 1.

First, the general construction of the impeller will be described herein below with reference to FIGS. 3-6. As shown in FIG. 4, pump casing 8 is covered with casing cover 10, and the pump casing 8 includes a central cavity 24 of circular cross-section which is sized to receive impeller 12 rotatably coupled in the cavity. The pump casing 8 and casing cover 10 respectively include circular flow channels or circulation grooves 20 and 22 of generally semicircular cross-section in fluid communication with the central cavity 24 of the casing 8.

As shown in FIGS. 3-6, the impeller 12 comprises a plurality of blades 32 which are provided around the outer edge of impeller body 28 while being spaced out at regular or irregular intervals. Thus, a plurality of blade grooves 26 are defined between the blades 32, and also between a circular outer rim 30 and the central impeller body 28, such that each of the blade grooves 26 is vertically formed through the impeller 12 as shown. The blade grooves 26 are in fluid communication with the grooves 20 and 22 of the casing 8 and casing cover 10. A horizontally projected ridge 38 is extending radially outwardly from the central body 28, along an inner circumferential surface of each of the blade grooves 26 to divide each of the blade grooves 26 into upper and lower sections as depicted in FIG. 4. Extending from the ridge 38, two oppositely disposed outer convex regions 34 and 36 are formed at the outer section of the central body 28 with the regions 34 and 36 preferably having the same or substantially similar surface radius as that of the flow channel grooves 20 and 22 in order to facilitate fluid circulation around the two opposing circular cavities defined respectively by the upper groove 20 and the upper convex region 34 and by the lower groove 22 and the lower convex region 36.

To allow for a smooth flowing of fuel into and out of the blade grooves 26, each of the blades 32 is formed in a V-shaped cross-sectional shape having oppositely inclined side surfaces extending from the center of the blade, with upper and lower inclined surfaces respectively formed on upper and lower parts of each side surface of each blade 32 to be symmetrical with respect to the horizontal ridge 38. The preferred shape of each blade 32 is further described below in details.

Figure 5:
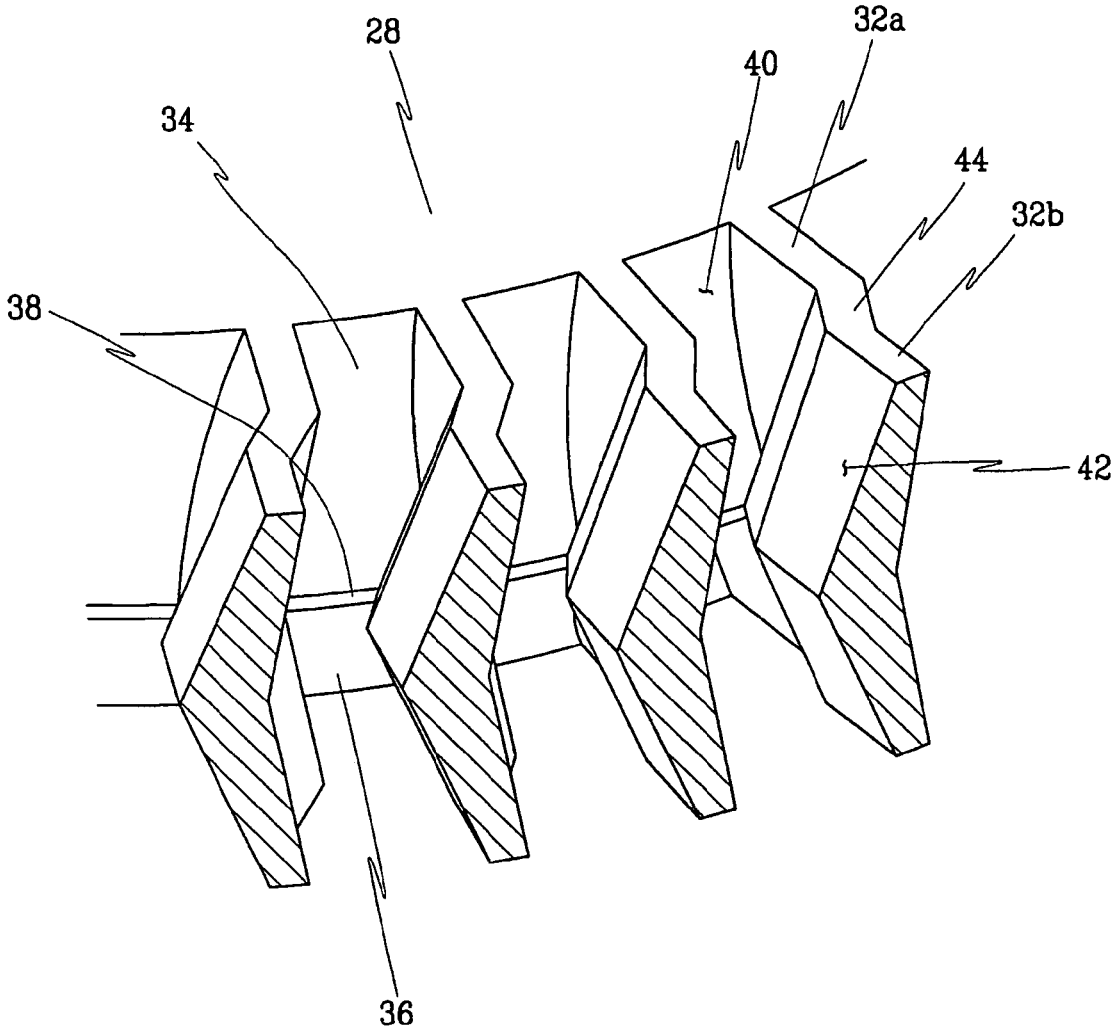
FIG. 5 is a partially broken and enlarged perspective view of a part of the impeller of FIG. 3.
Figure 6:
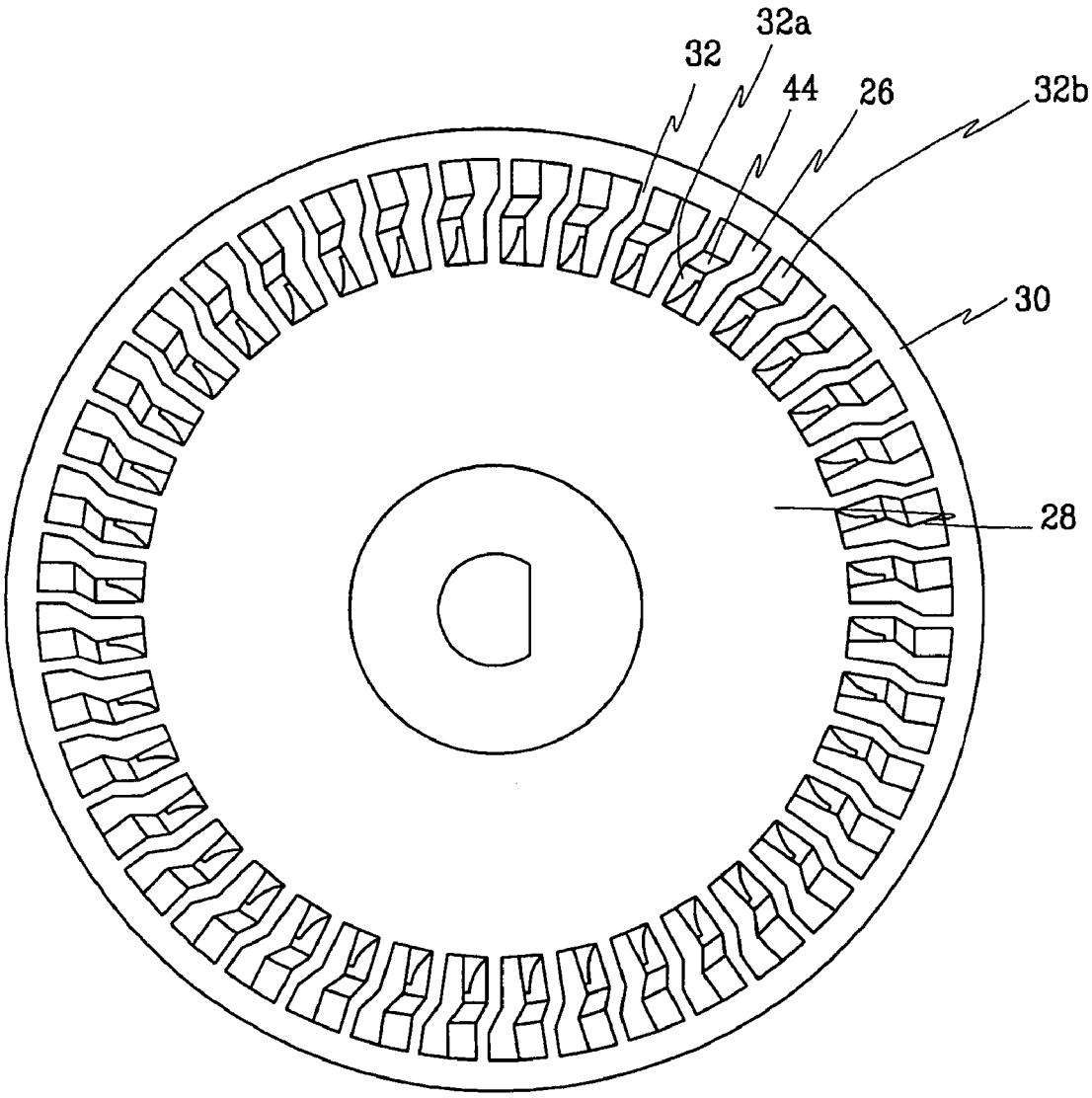
FIG. 6 is a top plan view of the impeller of FIG. 3.

As shown in FIGS. 4-5, in particular with FIG. 4 illustrating fuel currents within each of the blade grooves 26, a fuel inlet (inflow) region 40 through which fuel flows into the blade groove 26 is defined at an inside area of the blade groove 26, while a fuel outlet (outflow) region 42 through which the fuel flows out of the blade groove 26 is defined at an outside area of the blade groove 26. In the present invention, the fuel inlet region 40 and the fuel outlet region 42 are divided by a boundary region 44 for facilitating independent and non-disturbing flow in the adjacent regions where the fuel flows in the opposite direction. The boundary region 44 extends between the fuel inlet region 40 and the fuel outlet region 42 while bent in one direction, preferably bent in a direction opposite to the rotating direction of the impeller 12. By this configuration, each blade 32 is composed of fuel inlet blade portion 32*a* (in the fuel inlet region 40) and fuel outlet blade portion 32*b* (in the fuel outlet region 42), however, they are not extending in a straight line relative to each other as in conventional impellers described above.

The fuel inlet blade portion 32*a* is configured to have a thickness preferably of the same throughout the V-shaped section. Optionally, in consideration of the actual manufacturing process for facilitating discharge of the impeller product from the mold, the thickness of the fuel inlet blade portion 32*a* can be gradually reduced to a small degree toward the terminal ends (i.e., edges) relative to the thickness at the central portions (i.e., the V-shaped central bent portions) of the fuel inlet blade portion 32*a*. Having substantially the same thickness throughout the section of the inlet blade portion 32, the frictional loss in the fuel flow can be reduced because the inlet angle of the fuel becomes substantially the same.

Figure 7:
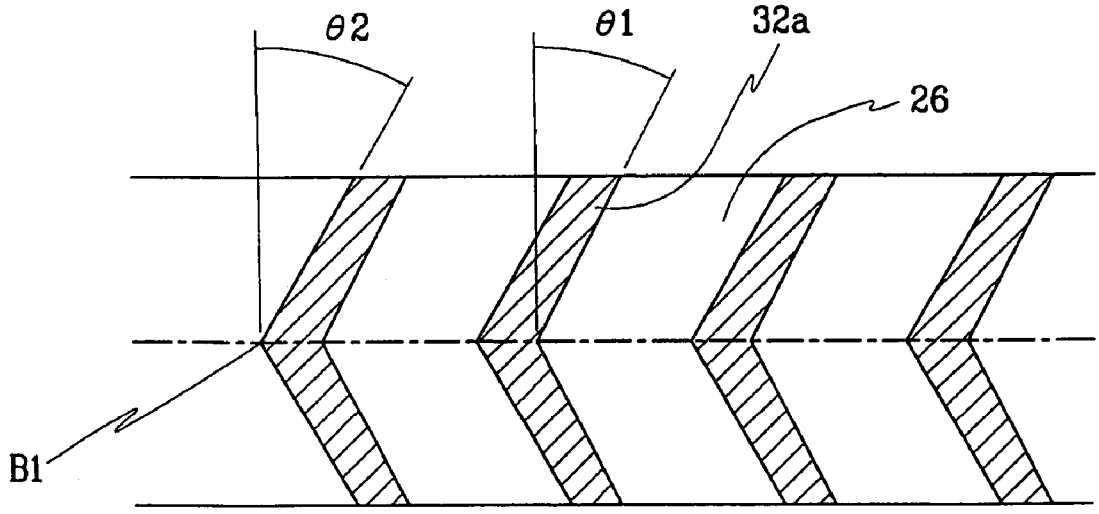
FIG. 7 is a side sectional view taken along a part of the fuel inlet region of the impeller of FIG. 3.
Figure 8:
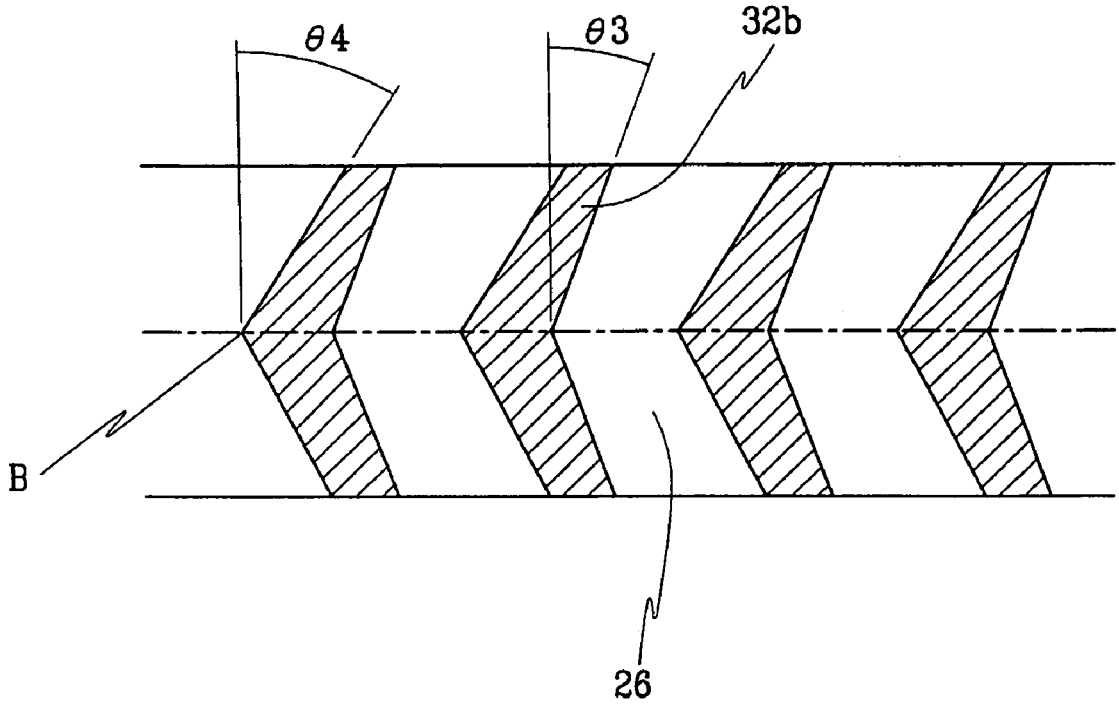
FIG. 8 is a side sectional view taken along a part of the fuel outlet region of the impeller of FIG. 3.

In the drawings, reference θ1 and θ2 respectively denote a front surface angle (or inflow leading-face angle) and a rear surface angle (or inflow trailing-face angle) of the fuel inlet blade portion 32*a* as shown in FIG. 7, and reference θ3 and θ4 respectively denote a front surface angle (or outflow leading-face angle) and a rear surface angle (or outflow trailing-face angle) of the fuel outlet blade portion 32*b* as shown in FIG. 8, in which each surface angle θ1-θ4 is measured relative to a reference line extending vertically from the outer surface of the impeller body 28. Each of the front surface angle θ1 and the rear surface angle θ2 of the fuel inlet blade portion 32*a* are configured to have a larger angle than the front surface angle θ3 of the fuel outlet blade portion 32*b*. The thickness of the fuel outlet blade portion 32*b* gradually reduces as it approaches from the central area of the blade to the terminal ends of the blade as shown FIG. 8. In addition, the rear surface angle θ4 gradually increases as it approaches from the root of the blade (i.e., the hub of the impeller body in the fuel inlet region) to the tip of the blade, but it is preferable that the front surface angle θ3 gradually decreases as it approaches from the root of the blade (i.e., the hub of the impeller body in the fuel inlet region) to the tip of the blade.

It is preferable that the front surface angle θ1 and the rear surface angle θ2 of the fuel inlet blade portion 32*a* are formed in the same angle, however, the tip portion can optionally be made a little thinner for facilitating discharge of the impeller product from the mold.

Figure 10:
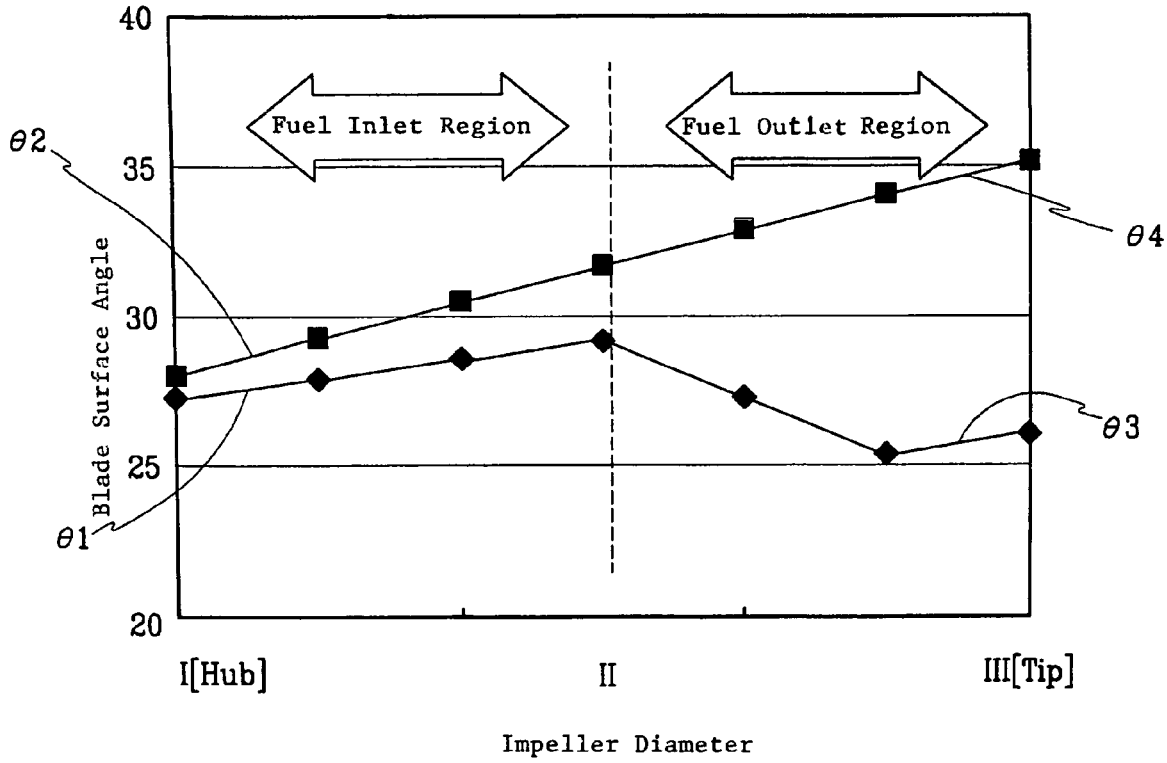
FIG. 10 is a graph for illustrating an example of the surface angle distribution of the impeller of FIG. 3 with respect to the lengthwise section (i.e., diameter) of the impeller.

As illustrated in FIG. 10, the fuel inlet blade portion 32*a* in the fuel inlet region 40 is not configured to have the same blade angle between the root area of the impeller body 28 to the tip area of the outer rim 30, but is configured to have a shape that both of the front surface angle θ1 and the rear surface angle θ2 increase gradually and that the rear surface angle θ4 of the fuel outlet blade portion 32*b* in the fuel outlet region 42 also increases gradually.

To the contrary, however, the front surface angle θ3 of the fuel outlet blade portion 32*b* in the fuel outlet region 42 is preferably shaped to generally decrease as approaching towards the tip area of the outer rim 30 in order to facilitate a smoother outlet flow of the fuel. If the front surface angle θ3 of the fuel outlet blade portion 32*b* decreases continuously to the tip of the outer rim 30, the central portion of each blade becomes thick and the cavity volume of the blade grooves becomes too small to function adequately. Thus, according to one preferred embodiment of the present invention as shown in FIG. 10, this drawback is offset by increasing the front surface angle θ3 at the tip portion of the fuel outlet blade portion 32*b* to a small degree.

According to the preferred embodiment as shown in FIGS. 7 and 8, the fuel outlet blade portion 32*b* in the fuel outlet region 42 is configured to have a generally decreasing front surface angle θ3 and a gradually increasing rear surface angle θ4 as approaching to the tip portion of the blades, and thus, the thickness at V-shape bending area B in the fuel outlet blade portion 32*b* becomes greater than the thickness at V-shape bending area B1 in the fuel inlet blade portion 32*a*.

Figure 9:
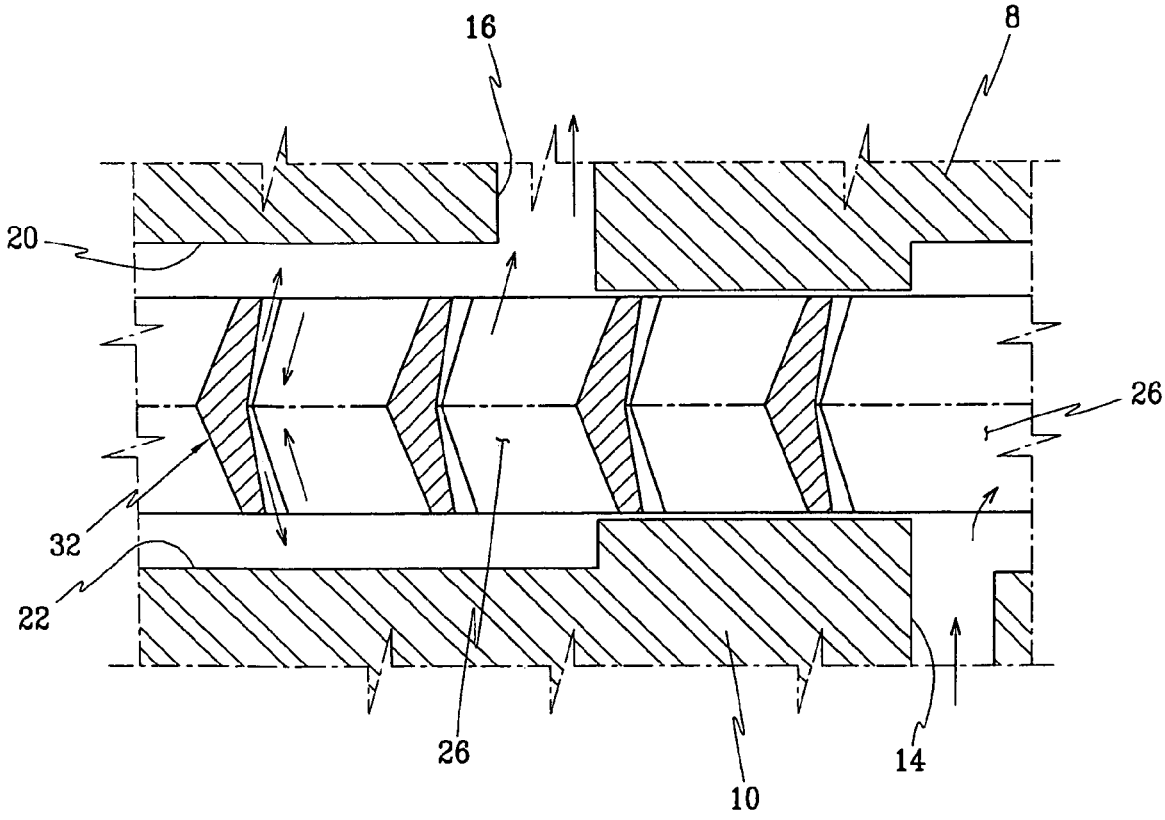
FIG. 9 is a side sectional view illustrating flow of fuel about the impeller of FIG. 3 that is installed in the fuel pump.

According to the preferred embodiment as shown in FIG. 9, the rear surface angle θ2 in the fuel inlet blade portion 32*a* is shaped to gradually (or generally proportionally) increasing from about 27° to about 33° in its radial outward direction. However, in alternate embodiments, this rear surface angle θ2 can increase in a range from about 20° to about 45° in its radial outward direction. In the preferred embodiment as shown in FIG. 9, the front surface angle θ3 in the fuel outlet blade portion 32*b* is shaped to gradually (or generally proportionally) decreasing from about 29° to about 25° in its radial outward direction. However, in alternate embodiments, this front surface angle θ3 can decrease in a range from about 40° to about 20°.

Figure 2:
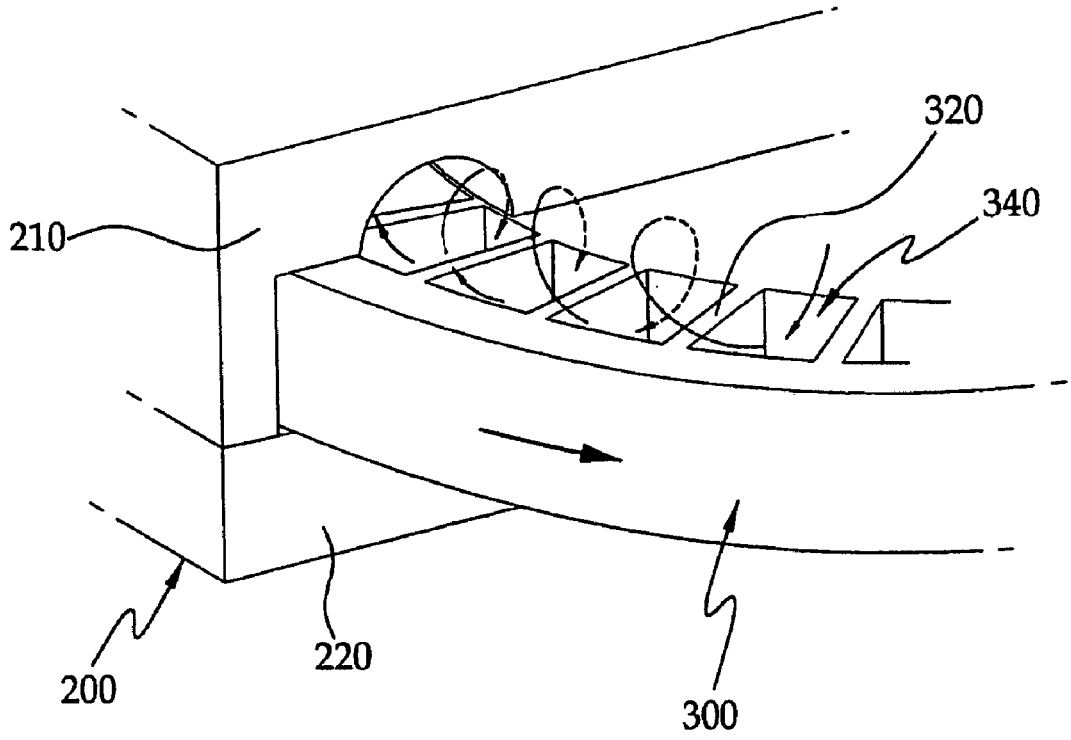
FIG. 2 is a perspective view illustrating the construction and operation of a conventional impeller installed in a fuel pump such as the fuel pump of FIG. 1.

As illustrated in FIG. 4, in operation the impeller 12 of the present invention starts rotating when the rotating shaft 18 of a driving motor (such as motor 400 assembled in the fuel pump as shown in FIG. 1) rotates, and the fuel in the fuel tank (not shown) starts flowing through a fuel inlet port (such as fuel inlet port 230 of the fuel pump as shown in FIG. 1). The fuel introduced to the blade grooves 26 from the fuel inlet port 230 is subject to a rotating force by the rotating blades 32 and leads to a circulation flow about the impeller 12. More specifically, the fuel is first directed outwards in the blade groove 26 by the centrifugal force due to rotation of the impeller 12, it then flows around the semicircular grooves 20 and 22 of the pump casing 8 and casing cover 10 and circulates about the impeller 12 in a similar manner illustrated in connection with FIG. 2 described above. As the fuel circulates about the impeller 12 rotating in a high speed, the pressure of the fuel increases over a certain preset value and the fuel exits the fuel outlet port 240 is then directed to the combustion chamber (not shown) of the vehicle engine.

According to the present invention, because the front and rear surface angles of the blades 32 at the fuel inlet region 40 and the fuel outlet region 42 are selected to have varying slope of optimized degrees as described above, the circulation efficiency and discharging pressure of the fuel becomes maximized and the energy loss during the circulation becomes minimized. Moreover, the discharging amount of the fuel from the impeller can also be maximized by having the optimized blade configuration in which the front surface angle θ3 in the fuel outlet blade portion 32*b* is smaller than the rear surface angle θ4. Thus, the impeller of the invention provides a superior pump as compared to the conventional impellers discussed above.

A better understanding of the present invention may be obtained through the following examples which are set forth to illustrate, but are not to be construed as the limit of the present invention. The following examples were executed using similitude of fuel pumps having various impellers with different fuel guide angles by the Fluid Machinery Laboratory of Seoul National University of Korea to define the relation between the inlet guide angles within the fuel inlet regions and the outlet guide angles within the fuel outlet regions of the impellers.

EXAMPLE 1

An impeller was prepared, in which blades 32 were designed such that the average fuel inlet angles θ1 and θ2 of the fuel inlet blade portion 32*a* at the fuel inlet region 40 relative to a vertical plane of the impeller was set to 27°, and the average fuel outlet angle θ3 of the fuel outlet blade portion 32*b* at the fuel outlet region 42 relative to a vertical plane of the impeller was set to 25°. A similitude of a fuel pump having the impeller was operated while sequentially changing the operational pressure, and a variation in the amount (and pressure) of fuel discharge was measured. The measuring results are given in Table 1 and a performance curve of the fuel pump is given in the graph of FIG. 11.

EXAMPLE 2

An impeller was prepared, in which blades 32 were designed such that the average fuel inlet angles θ1 and θ2 of the fuel inlet blade portion 32*a* at the fuel inlet region 40 relative to a vertical plane of the impeller was set to 32°, and the average fuel outlet angle θ3 of the fuel outlet blade portion 32*b* at the fuel outlet region 42 relative to a vertical plane of the impeller was set to 38°. A similitude of a fuel pump having the impeller was operated while sequentially changing the operational pressure, and a variation in the amount (and pressure) of fuel discharge was measured. The measuring results are given in Table 1 and a performance curve of the fuel pump is given in the graph of FIG. 11.

EXAMPLE 3

An impeller was prepared, in which blades 32 were designed such that the average fuel inlet angles θ1 and θ2 of the fuel inlet blade portion 32*a* at the fuel inlet region 40 relative to a vertical plane of the impeller was set to 32°, and the average fuel outlet angle θ3 of the fuel outlet blade portion 32*b* at the fuel outlet region 42 relative to a vertical plane of the impeller was set to 25°. A similitude of a fuel pump having the impeller was operated while sequentially changing the operational pressure, and a variation in the amount (and pressure) of fuel discharge was measured. The measuring results are given in Table 1 and a performance curve of the fuel pump is given in the graph of FIG. 11.

TABLE 1

| Section | Average fuel inlet angle (θ1 and θ2) | Average fuel outlet angle (θ3) | Variation in amount of fuel discharge | Maximum efficiency point |
|---|---|---|---|---|
| Example 1 | 27° | 25° | Increase by 5-8% from reference | Move to high pressure side |
| Example 2 | 32° | 38° | Reference discharge | Reference |
| Example 3 | 32° | 25° | Increase by 2-5% from reference | Move to high pressure side |

Figure 11:
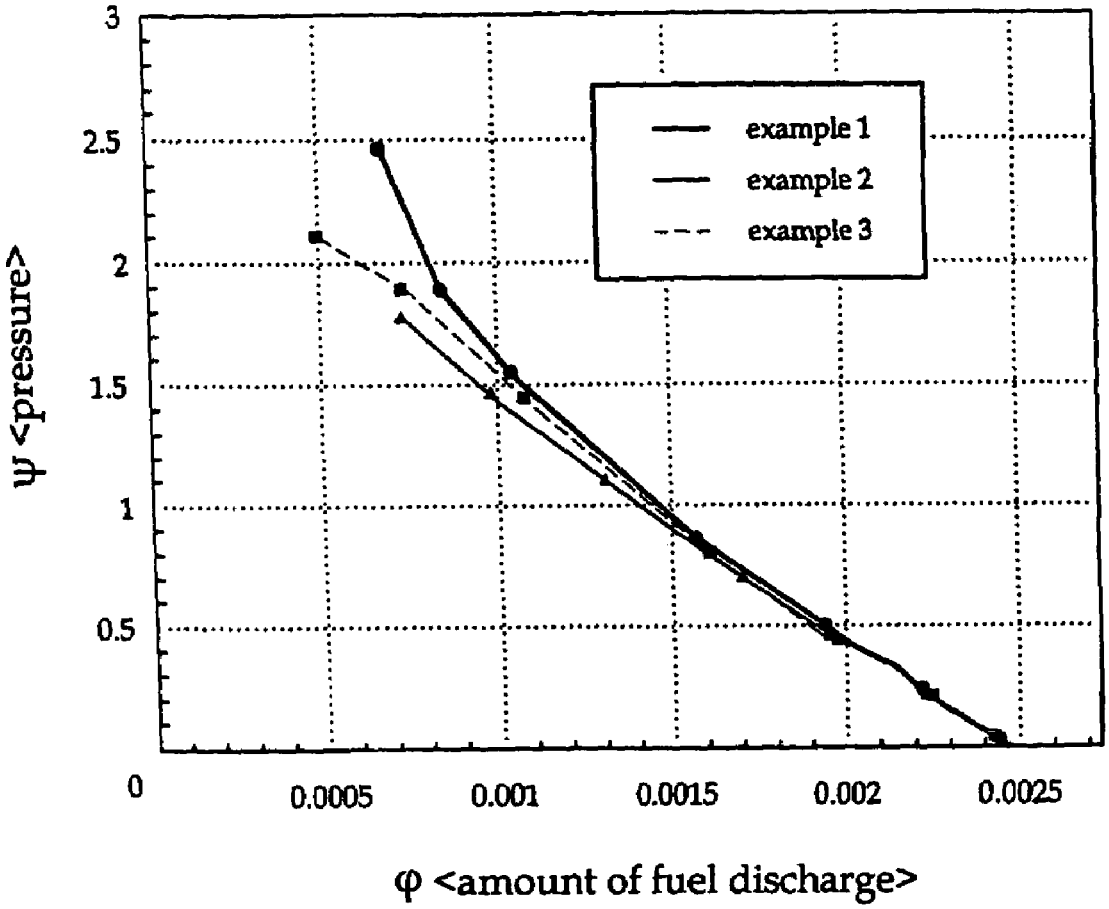
FIG. 11 is a graph illustrating the operational pressure of a fuel pump as a function of the effective amount and pressure of fuel discharge according to a change in the fuel inlet and fuel outlet angles of the impeller of present invention.

From Table 1 and the graph of FIG. 11, it is noted that, in each of Examples 1 and 3 of the present invention, the maximum efficiency point is moved to a high-pressure side, and the amount and pressure of fuel discharge during a high-pressure operation of the fuel pump is further increased in comparison with the reference Example 2. In general the amount of fuel discharge is proportional to the discharge pressure of the fuel in fuel pumps.

Therefore, when the impeller of the present invention with a fuel guide angle of an inlet guide region being different from a fuel guide angle of an outlet guide region is used in a fuel pump for automobiles, the fuel pump provides a higher operational performance at a high-pressure operation.

As apparent from the above description, the present invention provides a fuel pump for vehicles and an impeller thereof, that can improve or otherwise maximize the amount and pressure of fuel discharge in the fuel pumps by controlling the fuel inlet angle and the fuel outlet angle of the blades of the impeller, thus providing high operational pressures in the fuel pumps and also improving operational performances of the fuel pumps.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A fuel pump for a vehicle, the fuel pump comprising:

a driving motor;

an impeller having a substantially circular shape, the impeller being rotatable by operation of the driving motor; and a pump casing covered with a casing cover, the pump casing and casing cover together defining a central cavity for receiving the impeller rotatable therein, the pump casing and casing cover including a fuel inlet port and a fuel outlet port, the pump casing and casing cover each further including a circular groove formed along the surface thereof in respective fluid communication with the central cavity of the pump casing and casing cover;

wherein the impeller includes a plurality blades of generally V-shape cross-section disposed along an outer surface of the impeller with a plurality of blade grooves defined between the blades, the blade grooves in fluid communication with respective circular groove of the pump casing and casing cover;

wherein each of the blades includes a fuel inlet blade portion disposed at an inner area of the blade grooves and a fuel outlet blade portion disposed at an outer area of the blade grooves, a boundary portion disposed between the fuel inlet blade portion and the fuel outlet blade portion, in which a front surface angle and a rear surface angle of each of the fuel inlet blade portion and the fuel outlet blade portion are respectively varying relative to the length of each of the blades.

2. The fuel pump of claim 1, wherein the impeller includes a ridge projecting horizontally outwards along the inner area of the blade grooves.

3. The fuel pump of claim 1, wherein the front surface angle of the fuel outlet blade portion is less than the rear surface angle of the fuel inlet blade portion.

4. The fuel pump of claim 3, wherein the front surface angle of the fuel outlet blade portion gradually decreases towards the outer area of each of the blades.

5. The fuel pump of claim 4, wherein the front surface angle of the fuel outlet blade portion increases at a tip portion of each of the blades after gradually decreasing as approaching towards the outer area of each of the blades.

6. The fuel pump of claim 1, wherein a thickness at a central V-shaped portion of the fuel outlet blade portion is thicker than a thickness at a central V-shaped portion of the fuel inlet blade portion.

7. The fuel pump of claim 1, wherein the front surface angle of the fuel outlet blade portion is less than the front surface angle of the fuel inlet blade portion.

8. The fuel pump of claim 1, wherein the front surface angle of the fuel outlet blade portion gradually decreases towards the outer area of each of the blades from about 40° to about 20°.

9. The fuel pump of claim 1, wherein the rear surface angle of the fuel inlet blade portion gradually increases towards the outer area of each of the blades from about 20° to about 45°.

10. An impeller for a fuel pump of a vehicle, the fuel pump having a pump casing and a casing cover coupled with each other face to face and having a central cavity defined therein, the pump casing and casing cover each further including a circular groove formed along a respective inner surface opposing to each other, the respective circular groove in fluid communication with the central cavity of the pump casing and casing cover, the impeller comprising:

an impeller body formed in a substantially circular shape, the impeller body being rotatably disposed in the central cavity of the pump casing and casing cover;

a plurality blades of generally V-shape cross-section disposed along an outer surface of the impeller body with a plurality of blade grooves defined between the blades, the blade grooves in fluid communication with the respective circular groove of the pump casing and casing cover;

a ridge projecting horizontally outwards from an outer surface of the impeller body at an inner area of each of the blade grooves;

each of the blades including a fuel inlet blade portion disposed at an inner area of the blade and a fuel outlet blade portion disposed at an outer area of the blade, a boundary portion disposed between the fuel inlet blade portion and the fuel outlet blade portion, a front surface angle and a rear surface angle of each of the fuel inlet blade portion and the fuel outlet blade portion respectively varying relative to the length of each of the blades.

11. The impeller of claim 10, wherein each of the blades is configured to have the front surface angle and rear surface angle of the fuel inlet blade portion and the rear surface angle of the fuel outlet blade portion, respectively, gradually increasing, and the front surface angle of the fuel outlet blade portion first gradually decreasing and then gradually increasing, as they respectively approaches from a root area of the blade towards a tip area of the blade.

* * * * *